United States Patent [19]

Ohki et al.

[11] 4,144,859

[45] Mar. 20, 1979

[54] OVEN-ROTATION PREVENTION METHOD AND CIRCUIT IN THE NON-CONTACT TYPE IGNITION CIRCUIT FOR THE INTERNAL COMBUSTION ENGINE

[75] Inventors: Yoshinori Ohki; Komiya Hirokichi, both of Tokyo, Japan

[73] Assignee: Iida Denki Kogyo K.K., Tokyo, Japan

[21] Appl. No.: 748,462

[22] Filed: Dec. 8, 1976

[30] Foreign Application Priority Data

| | | | |
|---|---|---|---|
| Dec. 15, 1975 | [JP] | Japan | 50-149297 |
| Dec. 15, 1975 | [JP] | Japan | 50-149298 |
| Feb. 9, 1976 | [JP] | Japan | 51-13028 |
| Mar. 4, 1976 | [JP] | Japan | 51-23592 |
| Apr. 8, 1976 | [JP] | Japan | 51-39754 |
| Apr. 16, 1976 | [JP] | Japan | 51-43181 |
| Apr. 19, 1976 | [JP] | Japan | 51-44272 |
| Apr. 26, 1976 | [JP] | Japan | 51-47525 |
| Apr. 27, 1976 | [JP] | Japan | 51-52954 |

[51] Int. Cl.[2] ..... F02P 1/00; F02P 9/00

[52] U.S. Cl. ..... 123/148 CC; 123/148 S; 123/102; 123/148 E

[58] Field of Search ..... 123/148 S, 102, 198 DC, 123/198 D, 148b CC, 117 A, 117 R; 315/209 SC

[56] References Cited

U.S. PATENT DOCUMENTS

| | | | |
|---|---|---|---|
| 3,312,860 | 4/1967 | Sturm | 315/209 SCR |
| 3,356,082 | 12/1967 | Jukes | 123/102 |
| 3,443,556 | 5/1919 | Vadala | 315/209 SCR |
| 3,665,903 | 5/1972 | Harris et al. | 123/102 |
| 3,716,758 | 2/1973 | Palazzetti | 315/209 SCR |
| 3,809,044 | 5/1974 | Jereb et al. | 123/148 CC |
| 3,839,659 | 10/1974 | Bruijning et al. | 315/209 SCR |
| 3,851,636 | 12/1974 | Just et al. | 315/209 SCR |
| 3,964,461 | 6/1976 | Wesemeyer et al. | 123/148 CC |
| 3,967,604 | 7/1976 | Kondo | 123/102 |
| 3,980,922 | 9/1976 | Katsumata et al. | 315/209 SCR |
| 4,010,726 | 3/1977 | Kondo et al. | 123/102 |
| 4,038,951 | 8/1977 | Schweikart | 123/102 |
| 4,038,951 | 8/1977 | Schweikart | 123/148 CC |
| 4,074,665 | 2/1978 | Patis | 123/102 |
| 4,077,372 | 3/1978 | Masta | 123/117 R |

FOREIGN PATENT DOCUMENTS

| | | | |
|---|---|---|---|
| 2240475 | 2/1974 | Fed. Rep. of Germany | 123/102 |
| 2611279 | 10/1976 | Fed. Rep. of Germany | 123/148 S |

*Primary Examiner*—Charles J. Myhre
*Assistant Examiner*—R. A. Nelli
*Attorney, Agent, or Firm*—Fidelman, Wolffe & Waldron

[57] ABSTRACT

In a non contact ignition circuit for an internal combustion engine, a current induced in the primary winding of an ignition coil is controlled and cut-off by operation, on and off, of a thyristor so as to produce a discharge in a spark plug. A capacitor connected to the gate of the thyristor is charged with an inverse voltage. When the rotational speed of the internal combustion engine exceeds a predetermined level, i.e. a state of overrotation, the inverse voltage stored in the capacitor is discharged whereby the gate potential of the thyristor is negatively biased relative to the cathode. Accordingly, during the discharging period of the capacitor, the triggering time of the thyristor and sparking are retarded as compared to the normal running condition of the internal combustion engine. Thereby overrotation of the internal combustion engine is prevented.

9 Claims, 6 Drawing Figures

OVEN-ROTATION PREVENTION METHOD AND CIRCUIT IN THE NON-CONTACT TYPE IGNITION CIRCUIT FOR THE INTERNAL COMBUSTION ENGINE

This invention relates to an overrotation prevention method in a non-contact ignition circuit for an internal combustion engine and an overrotation prevention circuit embodying the method.

The term "overrotation" herein refers to a state where engine rotational speed abnormally increases, and particularly, this tends to occur when load is rapidly changed from full load to no-load. Prior art approaches adapted to prevent overrotation of an internal combustion engine often include a governor mechanism of mechanical structure, or when rotational speed of the internal combustion engine exceeds a predetermined level, spark discharge at the spark plugs is stopped.

In accordance with the above-mentioned second approach in which spark discharge at the plug is stopped, gas is forced into the engine cylinder, which poses a difficulty in providing re-ignition and various other inconveniences. For this reason, generally, the governor mechanism has been utilized.

The governor mechanism, comprises a flyweight and a spring coupled to the flyweight. An increase of the centrifugal force acting on the flyweight, which increases in proportion to the rotational speed of the crank shaft, causes a displacement against the spring force of the flyweight so as to control excessive rotational speed of the internal combustion engine.

As described above, the conventional mechanical governor mechanism requires the flyweight and the spring. In addition, there is required a space large enough to allow the flyweight to rotate since the latter rotates integral with the crank shaft. Space enough to allow the crank shaft to be displaced as the rotational speed thereof varies is also required. Hence, the mechanism becomes extremely bulky. As a consequence, it is difficult for the governor mechanism, which is often mounted in a very narrow space, to be mounted on the internal combustion engine, and above all, the mechanical service life thereof is decreased due to deterioration of the spring and the like.

Various overrotation prevention circuits have recently been proposed for electrically retarding ignition timing in an ignition circuit to prevent overrotation of the internal combustion engine in an effort to avoid various disadvantages noted above with respect to the mechanical governor mechanism. In accordance with most of the aforementioned circuits, however, there is a limitation in the angle of delay; the amount of delay is maintained at a given value by operation of the overrotation prevention circuit. Thus, in the case where the rotational speed of the internal combustion engine tends to increase, for some reason despite operation of the overrotation prevention circuit, it is impossible in the prior circuits to inhibit such an increase of the rotational speed. Another problem with the prior art circuits is that the overrotation prevention circuit at a time of normal rotational speed of the internal combustion engine, causes normal ignition timing to be retarded slightly.

The present invention eliminates the disadvantages and inconvenience noted above with respect to the aforementioned prior art examples by providing a method and apparatus for preventing overrotation of an internal combustion engine. The apparatus comprises a non-contact ignition circuit for an internal combustion engine in which a current induced in a primary winding or an ignition coil, with a plug connected to a secondary winding thereof, is controlled in its conduction and cut-off by the operation, on and off, of a thyristor so as to produce a spark discharge in the plug. When rotational speed of the internal combustion engine exceeds a predetermined level, i.e., overrotation, the inverse voltage stored in a capacitor connected to the gate of the thyristor is discharged to drop the gate potential of the thyristor, thereby retarding the triggering time of the thyristor and the time of sparking. During the discharging of the capacitor, overrotation of the internal combustion engine is prevented.

Accordingly, it is an object of this invention to electrically prevent overrotation of an internal combustion engine.

Another object of this invention is to increase the overrotation prevention response as the overrotation of the internal combustion engine increases.

Another object of this invention is to initiate the overrotation prevention operation in accordance with an induced voltage which increases in proportion to rotational speed of the internal combustion engine.

Still another object of this invention is to prevent the ignition circuit from being electrically influenced by the overrotation prevention circuit when the internal combustion engine is in normal running condition.

Still another object of this invention is to enable free selection of the rotational speed for commencing an overrotation prevention operation of the internal combustion engine without influencing the normal ignition circuit.

The invention will be better understood from a reading of the following detailed description thereof, when taken in conjunction with the drawing wherein.

Figure 2:
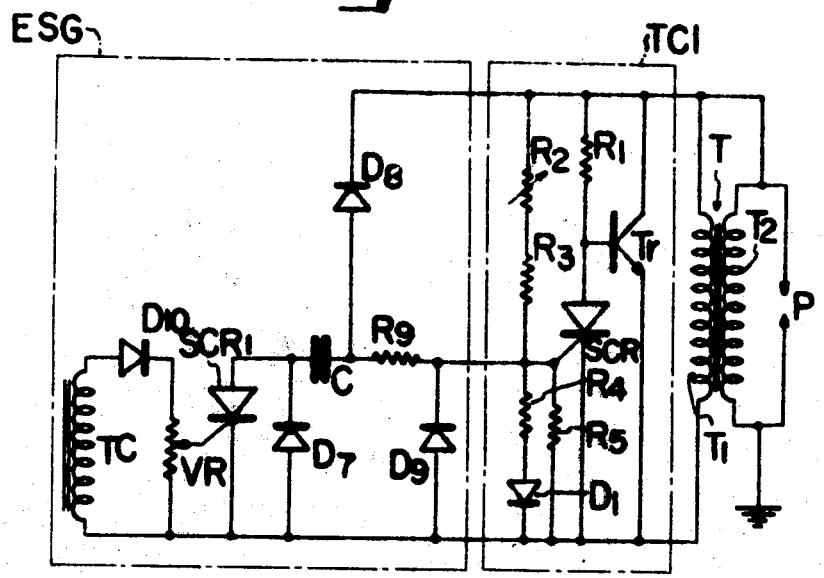
FIG. 2 is a schematic electric connection diagram illustrating a basic circuit of this invention.
Figure 3:
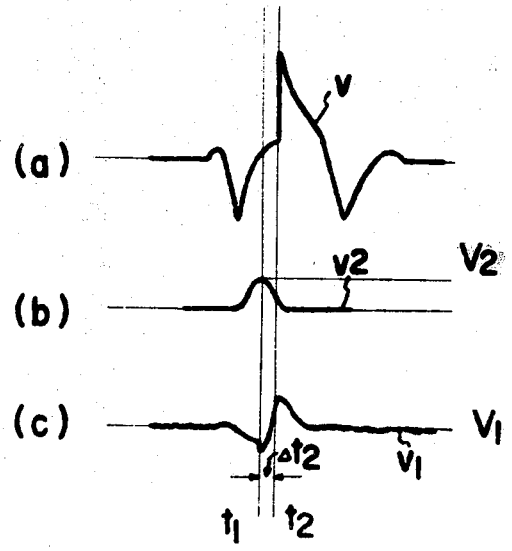
Figure 4:
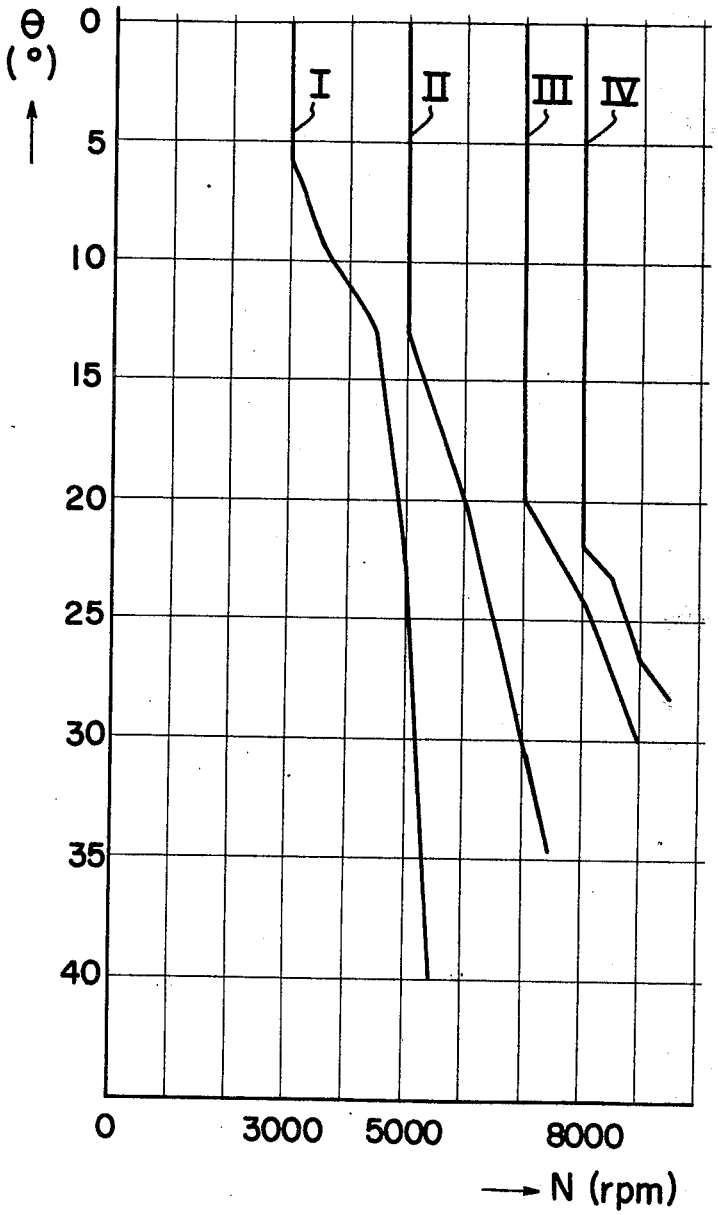
Figure 5:
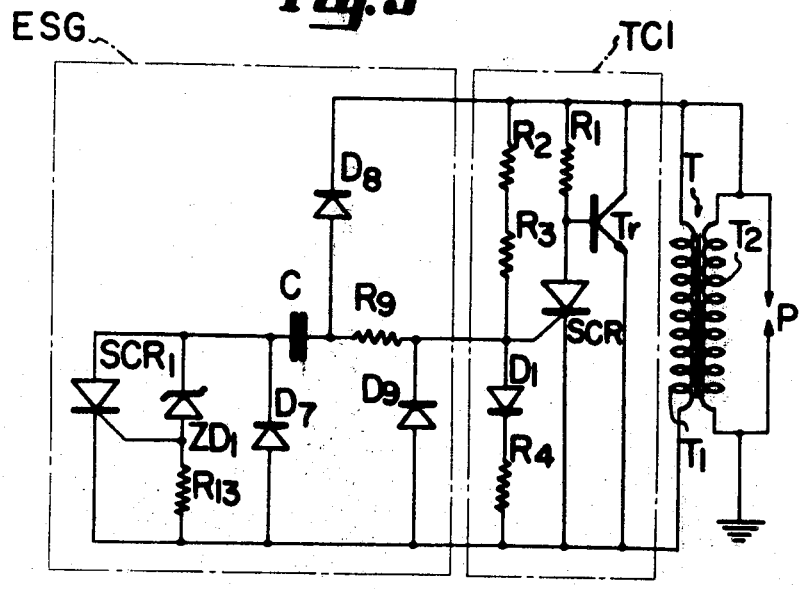
Figure 6:
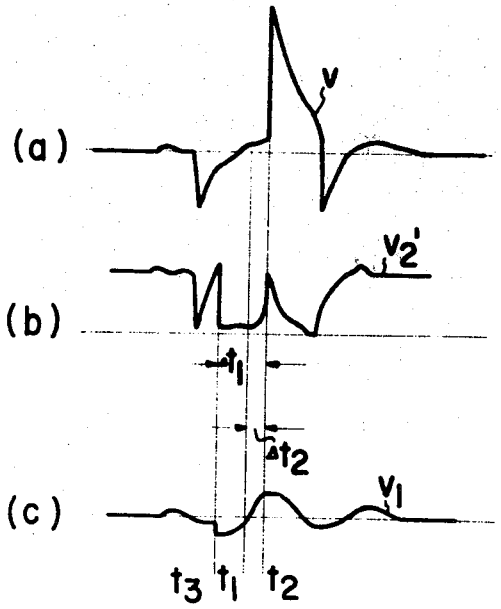

FIG. 3 illustrates operating voltage waveforms in the circuit shown in FIG. 2, FIG. 3 (*a*) illustrates a voltage waveform formed between opposite terminals of a primary winding. FIG. 3(*b*) illustrates a gate voltage waveform of a thyristor forming a discharge switch circuit. FIG. 3 (*c*) illustrates a gate voltage waveform of a thyristor in the ignition circuit;

FIG. 4 is a diagram of operating characteristics showing the magnitude of angle of lag relative to rotational speed in the overrotation prevention circuit shown in FIG. 2;

FIG. 5 is an alternative schematic electric connection diagram of this invention showing an improvement over that shown in FIG. 2 wherein the discharge switch circuit is triggered in accordance with the charging voltage of a capacitor;

FIG. 6 illustrates voltage waveforms at essential parts in the circuit shown in FIG. 5, in which FIG. 6 (*a*) illustrates a voltage waveform formed between opposite terminals of a primary winding, FIG. 6 (*b*) illustrates a voltage waveform between anode and cathode of a thyristor forming a discharge switch circuit, and FIG. 6 (*c*) illustrates a gate voltage waveform of a thyristor in the ignition circuit.

Various embodiments of the present invention will now be described with reference to the accompanying drawings.

As previously mentioned, the present invention is applied to a non-contact ignition circuit for an internal combustion engine in which a current, induced in the primary winding $T_1$ of an ignition coil T having a plur P connected to the secondary winding $T_2$, is controlled and cut-off by the on and off action of a thyristor SCR. The ignition circuits, to which this invention is applied, are roughly divided into two types, namely, an induction discharge type ignition circuit (TCI) and a capacity discharge type ignition circuit (CDI).

The induction discharge type ignition circuit (FIG. 2) TCI comprises a resistor $R_1$ inserted as a base resistor between the collector and base of a transistor Tr. The transistor Tr is connected in parallel with the primary winding $T_1$ of the ignition coil T. A thyristor SCR is inserted between the base and emitter of the transistor Tr with the thyristor anode connected to the base. A resistance circuit comprising a resistor $R_2$ (in the form of a variable resistor for setting the trigger time of the thyristor SCR) and a series resistor $R_3$ are inserted between the gate of the thyristor SCR and collector of the transistor Tr. A series circuit comprising a diode $D_1$ (for temperature compensation) in series with a resistor $R_4$ is inserted between the gate and cathode of the thyristor SCR.

In the ignition circuit (TCI), as is apparent from its construction (see FIGS. 2,5), when a forward induced voltage is produced in the primary winding $T_1$, such that a base current flows into the base of the transistor Tr through the resistor $R_1$, the transistor Tr is placed in conduction. Thus, current flows in the primary winding $T_1$ through the transistor Tr.

When the primary current increases in value, as the induced voltage in the primary winding $T_1$ increases, a shunt current flowing into the gate circuit of the thyristor SCR through resistors $R_2$, $R_3$, $R_4$, $R_5$ and $D_1$ also increases. Finally, the voltage drop in the gate circuit reaches the trigger voltage of the thyristor SCR at a time in the induced voltage cycle set by the value of the resistor $R_2$. As a consequence the thyristor SCR turns on.

When the thyristor SCR turns on, the potential difference between the base and emitter of the transistor Tr is almost zero, because the thyristor SCR shunts across the base and emitter so that the transistor Tr is cut off at the moment when the thyristor SCR turns on. When the transistor Tr current is cut off, the current flowing into the primary winding $T_1$ is rapidly cut off.

This rapid cut off of the current flowing into the primary winding $T_1$ causes a high voltage to be induced in the secondary winding $T_2$ of the transformer T and produces a spark discharge in plug P.

Thus, according to the present invention, the capacitor C connected to the gate of thyristor SCR used in the ignition circuits TCI and CDI is charged with an inverse voltage, and when rotational speed of the internal combustion engine exceeds a predetermined value, i.e., a state of overrotation, the inverse voltage stored in the capacitor C is discharged through a discharge circuit having a suitable time constant. This discharge of the capacitor C causes the gate potential of the thyristor SCR to be biased to a lower potential than that of the cathode of the thyristor SCR over a period of time, in accordance with the time constant of the discharge circuit of the capacitor C. Thus discharge disables triggering of the thyristor SCR so that the trigger time of the thyristor SCR is retarded for a period of time in accordance with the time constant of the discharge circuit of the capacitor C to thereby retard ignition timing of plug P. This retarded firing of the plug decreases overrotation and the rotational speed of the internal combustion engine.

Figure 1:
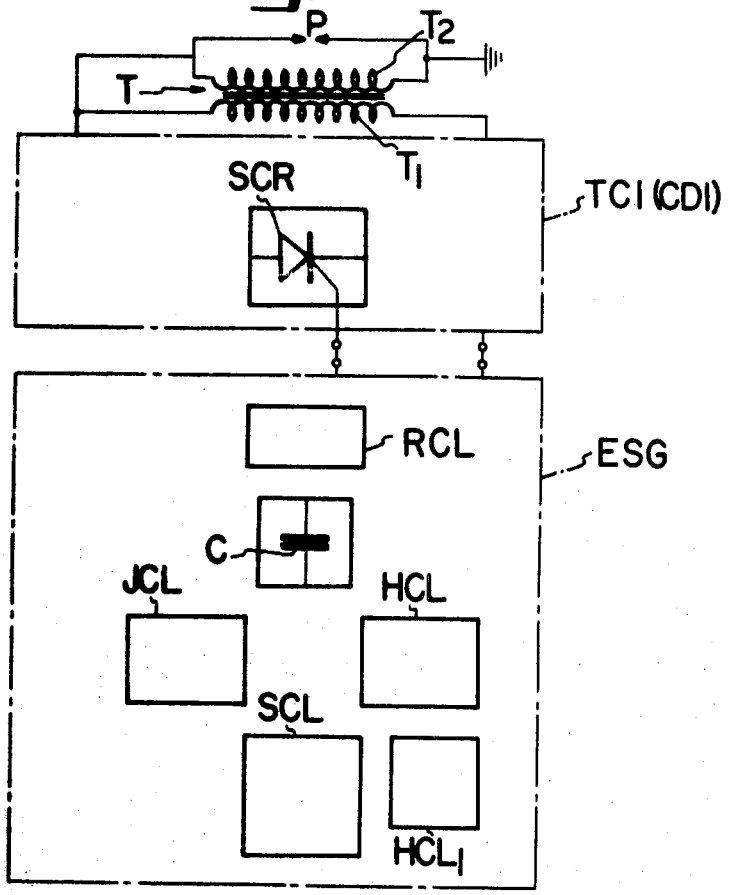
FIG. 1 is a block diagram showing a basic construction in accordance with the present invention.

Thus, in the present invention, the inverse voltage stored in the capacitor C, which is connected to the gate of the thyristor SCR used in the ignition circuits (TCI and CDI), is discharged when the internal combustion engine is in a state of overrotation to bias the gate of the thyristor SCR negatively with respect to the cathode so that the trigger time of the thyristor SCR is retarded over a period of time in accordance with the discharging time of the capacitor C to prevent overrotation of the internal combustion engine. Accordingly, an overrotation prevention circuit ESG (see FIGS. 1,2) embodying the present invention would require at least; a capacitor C of which one terminal is connected to the gate of the thyristor SCR used in the ignition TCI or CDI; a charging circuit (Jcl) for charging the capacitor C with an inverse voltage; a discharging circuit (Hcl) for discharging the inverse voltage stored in the capacitor C; and a discharge switch circuit (Scl) for closing the discharging circuit (Hcl) to discharge the capacitor C when rotational speed of the internal combustion engine is in overrotation.

A basic embodiment of the circuit ESG in accordance with the present invention, which is presumably a simplest form, will be discussed with reference to FIG. 2.

In the embodiment shown in FIG. 2, an overrotation prevention circuit (ESG) is connected to the ignition circuit (TCI) described above. Inserted between the gate and cathode of the thyristor SCR is a circuit loop comprising in series a resistor $R_9$ a capacitor C, and a second thyristor $SCR_1$ having its anode connected to the capacitor C and its cathode connected to the cathode of the thyristor SCR.

The gate circuit of the thyristor $SCR_1$ is a loop circuit comprising in series a trigger coil $TC_1$, a rectifying diode $D_{10}$ and a resistor VR. The thyristor $SCR_1$ has its gate connected to a movable contact of the resistor VR.

A rectifying diode $D_7$ is inserted between the negative terminal, i.e., lower end in FIG. 2, of the primary winding $T_1$ [also connected to the cathode of the thyristor $SCR_1$] and anode of the capacitor C. The anode is also connected to the cathode of the thyristor $SCR_1$. It should be noted that as defined herein and in FIG. 2 the anode of the capacitor C is the left terminal of the capacitor and the right terminal of the capacitor is defined as the cathode. A rectifying diode $D_8$ is inserted between the cathode of the capacitor C and positive terminal, i.e., upper end in FIG. 2, of the primary winding $T_1$ with the diode cathode connected to the positive terminal of the primary winding $T_1$. Both the diode and $D_7$ and $D_8$ form a charging circuit (JCL) for the capacitor C when an inverse voltage, that is negative at the transistor collector and positive at the emitter is induced in winding $T_1$.

Accordingly the inverse voltage induced in the primary winding $T_1$ is charged into the capacitors C. The capacitor is charged positive at its anode and negative at its cathode.

Further, a rectifying diode $D_9$ is inserted between the gate of the thyristor SCR [with resistor $R_9$ connected thereto] and the cathode of the thyristor $SCR_1$ with the anode of the diode $D_9$ connected to the cathode of the thyristor $SCR_1$. The combination of the diode $D_9$ and the resistor $R_9$ forms a portion of the discharging circuit [HCL] for the capacitor C.

This discharging circuit [HCL] forms a time constant circuit so that when the circuit comprising the capacitor C, thyristor $SCR_1$, diode $D_9$ and resistor $R_9$ is closed, the electric charge stored in the capacitor C is discharged in a period of time predetermined by the values of the capacitor C and resistor $R_9$.

With the embodiment shown in FIG. 2 constructed as above described, when the rotational speed of the internal combustion engine reaches a preselected level (set by the resistor VR), the thyristor $SCR_1$ is placed in conduction to discharge the electrical charge stored in the capacitors C. Discharge current flows from the anode (left terminal, FIG. 2) through the thyristor $SCR_1$, the diode $D_9$ and the resistor $R_9$, whereby gate potential of the thyristor SCR is decreased to the value representing the voltage drop across conducting diode $D_9$. Conduction of thyristor SCR is delayed until discharge of capacitor C is completed, that is, by the time set by the capacitor C and the resistor $R_9$. Thereby conduction of thyristor SCR is delayed (retarded) as compared to the normal firing time set by the resistors in the gate circuitry of the thyristor SCR and more particularly by the variable resistor $R_2$. Thus, above a preselected speed, spark retardation occurs to prevent overrotation of the internal combustion engine.

It should be noted that it is the setting of the variable resistor VR connected to the gate of the second thyristor $SCR_1$ which determines the speed at which retardation begins.

The operation of the aformentioned circuit will further be described in detail.

When the internal combustion engine is driven at a normal rotational speed, the gate voltage $V_2$ (see FIG. 3 (*b*)) of the thyristor $SCR_1$ due to the voltage induced, e.g., from a magnetic field associated with the engine flywheel, in the trigger coil $TC_1$ does not reach the trigger voltage of the thyristor $SCR_1$. Hence, the thyristor $SCR_1$ is not placed in conduction; as a consequence the retard circuit ESG which discharges the capacitor C, is not operated but only the ignition circuit ($TC_1$) of the transistor Tr and the thyristor SCR is operated. The engine operates normally.

When the rotational speed of the internal combustion engine increases for some reason from the normal state as described above to a speed level predetermined by the setting of the resistor VR, the gate voltage ($V_2$) of the thyristor $SCR_1$, said gate voltage being due to the voltage induced in the trigger coil $TC_1$, reaches the trigger voltage (see FIG. 3) (*b*)) of the thyristor $SCR_1$ to place the thyristor $SCR_1$ in conduction.

Conduction of $SCR_1$ imposes the voltage of capacitor C on the resistor $R_9$ because of the low voltage drop across the thyristor SCR, and diode $D_9$ during conduction. Accordingly, the gate of the ignition thyristor SCR which connects to the cathode of the diode $D_9$ is at a low potential relative to its cathode and will not fire. This inhibited condition of the thyristor SCR continues while capacitor C discharges. After the capacitor C is discharged, the gate of the ignition thyristor SCR goes positive relative to its cathode and the thyristor SCR fires. Firing of the thyristor SCR as stated above, shunts the transistor (Tr) base and emitter together and interrupts emitter collector current flow causing a spark at the plug P.

In other words, the thyristor $SCR_1$ is triggered, and as a consequence, the trigger time of the thyristor SCR is delayed by the time set by the time constant circuit formed by the capacitor C and the resistor $R_9$.

When the thyristor SCR conducts, the emitter-collector current is interrupted, as a consequence of which the voltage between the collector and the emitter of the transistor Tr is rapdly increased as shown in FIG. 3 (*a*) due to the well-known inductive kick in the primary winding $T_1$ to rapidly create a high voltage in the secondary winding $T_2$.

If the rotational speed of the internal combustion engine is greater than the speed set for firing the thyristor $SCR_1$ by the resistor VR, the protection circuit (ESG) is continuously operated to fire thyristor $SCR_1$ on every cycle. The delay time in firing thyristor SCR is fixed, set by the time constant circuit formed by the capacitor C and the resistor $R_9$ irrespective of the rotational speed of the internal combustion engine. Hence, a fixed time period represents a larger portion of the engines rotation cycle when the speed of rotation is higher; the higher the rotational speed of the internal combustion engine, the greater is the magnitude of angle of lag in firing the plug P thereby increasing the overrotation prevention effect accordingly.

FIG. 4 is a graphic representation showing the experimentally determined relation between the rotational speed of an internal combustion engine and the angle of lag produced by the protection circuit (ESG). Curve I illustrates the case where the lowest rotational speed for initiating firing of the protective circuit (ESG) is set to 3,000 rpm by the resistor VR. Curve II is the case where the starting rotational speed is set to 5,000 rpm; curve III is the case where the starting rotational speed is set to 7,000 rpm; and curve IV is the case where the starting rotational speed is set to 8,000 rpm.

It will be noted that the time constant in the time constant circuit is the same in all the cases and a flywheel, mounted on the internal combustion engine, is driven by the motor. This experiment was carried out merely to see the relation between the increase in the engines rotational speed and the effect on angle of lag as produced by the circuit ESG of the invention.

As may be seen clearly in comparison of the various curves, the magnitude of lag angle is conspicuously higher when the set speed for initiating firing delay is higher in spite of the same time constant. Thus, higher setting speeds increase the rotation-reducing effect produced by angle of lag.

As is also obvious from the curves in FIG. 4, even in the same setting condition, the degrees of lag angle increase as the rotational speed increases, and the firing delay which directly acts to prevent overrotation becomes greater in proportion to the increase in rotational speed.

It will be appreciated that if the thyristor SCR is triggered prior to the operation of the switching circuit (ESG), then the firing is not delayed even when overrotation exists. Accordingly, it is necessary to set the trigger time $t_1$ of the thyristor $SCR_1$ at a time slightly earlier than the trigger time of the thyristor SCR.

Accordingly, the width of angle of lag of the trigger time of the thyristor SCR by the circuit ESG is a value slightly smaller than the time constant set by the capacitor C and the resistor $R_9$.

In the embodiment shown in FIG. 2, the trigger time of the thyristor $SCR_1$ is set by the trigger coil $TC_1$ irrespective of the value of the inverse voltage charged in the capacitor C. Separately from the embodiment shown in FIG. 2, FIG. 5 illustrates another embodiment of the invention in which the thyristor $SCR_1$ is triggered in accordance with the value of the inverse voltage charged in the capacitor C.

The embodiment shown in FIG. 5 which is similar to the circuit of FIG. 2 except for the switching circuitry (ESG) which comprises a thyristor $SCR_1$ having its cathode connected directly to the cathode of the thyristor SCR to form a discharge circuit. The anode of the thyristor $SCR_1$ is connected to one terminal of the capacitor C while the other terminal of capacitor C connects to the gate of thyristor SCR via the resistor $R_9$. A rectifying diode $D_7$ shunts the thyristor $SCR_1$ with the diode $D_7$ anode connected to the cathode of the thyristor $SCR_1$, and the diode $D_7$ cathode connected to the anode of $SCR_1$. The diode $D_8$ connects its anode at the junction between the capacitor C and resistor $R_9$; the cathode of diode $D_8$ connects to the upper positive (FIG. 5) terminal of the primary winding $T_1$. Resistor $R_{13}$ is connected between the gate and cathode of the thyristor $SCR_1$. The cathode of thyristor $SCR_1$ connects to the cathode of the thyristor SCR. The Zener diode $ZD_1$ connects between the anode and gate of the thyristor $SCR_1$ with the Zener cathode connected to the thyristor anode. Diode $D_9$ has its cathode connected to the gate of the thyristor SCR and its anode connected to the cathode of thyristor SCR. The ignition circuit, identified as TCl in FIG. 5 and connected across the primary winding $T_1$ of the ignition transformer T, is substantially identical to those circuits identified as TCl in FIG. 2 and operates identically.

That is, the circuit shown in FIG. 5 is virtually identical in construction to that shown in FIG. 2 with the exception of the gate circuit of the thyristor $SCR_1$.

Thus, when an inverse voltage is induced in the primary winding $T_1$, that is, when the lower end (FIG. 5) of primary winding $T_1$ is positive, an inverse voltage is charged into the capacitor C, the charging current passing through the circuit (Jcl) which comprises the lower end of primary winding $T_1$, diode $D_7$, capacitor C, diode $D_8$ and back to the upper end of primary winding $T_1$.

On the other hand, the inverse voltage stored in the capacitor C is discharged by a current passing through the discharge circuit (Hcl) from the capacitor C, through thyristor $SCR_1$, diode $D_9$, resistor $R_9$, and back to the capacitor C.

Incidentally, since the inverse voltage to be stored in the capacitor C is the voltage induced in the primary winding $T_1$, it increases in proportion to the rotational speed of the internal combustion engine. Further, a series circuit comprising the Zener diode $ZD_1$ and the resistor $R_{13}$ is connected in parallel with a series circuit comprising the capacitor C, the resistor $R_9$ and the diode $D_9$. When the voltage between electrodes, positive on the left electrode, of the capacitor C, impressed across the Zener, exceeds the Zener breakdown voltage of the Zener diode $ZD_1$, the Zener diode $ZD_1$ conducts. As a result, an electric current is passed through the resistor $R_{13}$ and applies a gate voltage which triggers the thyristor $SCR_1$.

The value of the inverse voltage charged into the capacitor C in an overrotation state of the internal combustion engine can be determined beforehand whereby only when the rotational speed of the internal combustion engine is in the overrotation state, will the Zener diode $ZD_1$ breakdown and as a result, an electric current flows into the resistor $R_{13}$ to trigger the thyristor $SCR_1$.

This will be explained in accordance with the operation of the entire circuit (ESG) (FIG. 5).

When the rotational speed of the internal combustion engine is within the range of normal speeds, the inverse voltage charged into the capacitor C will not reach the Zener breakdown voltage of the Zener diode $ZD_1$ so that the circuit ESG is not operated and the thyristor SCR comes in conduction at the time $t_1$ set by the resistor $R_2$ to produce a spark discharge in plug P exactly as in the circuit of FIG. 2 described above.

Then when the rotational speed of the internal combustion engine increases for some cause or other, the inverse voltage induced in the primary winding $T_1$ also increases and the value of the voltage stored in the capacitor C also increases.

When the rotational speed of the internal combustion engine increases up to the overrotation value set previously to accommodate the Zener diode $ZD_1$, the inverse voltage stored in the capacitor C and impressed across the thyristor $SCR_1$ reaches the Zener breakdown voltage of the Zener diode $ZD_1$ and thyristor $SCR_1$ is fired to delay the spark at the plug P.

Incidentally, the breakdown of the Zener diode $ZD_1$ is not achieved at the same time when a potential difference between electrodes of the capacitor C first reaches the Zener voltage but occurs at time $t_3$ when the voltage between collector and emitter of the transistor Tr, i.e., the potential difference between terminals of the primary winding $T_1$, gradually changes from the maximum value in the inverse direction to the forward voltage, as shown in FIG. 6 (a).

As shown in FIG. 6 the change in voltage between anode and cathode of the thyristor $SCR_1$ for causing the Zener diode $ZD_1$ to breakdown assumes a minimum value, by forward conduction of diode $D_7$, when the inverse voltage of the primary winding $T_1$ is at maximum but an electric charge corresponding to the maximum value of the inverse voltage is charged into the capacitor C. As a consequence, the aforesaid anode to cathode voltage of $SCR_1$ increases as the inverse voltage of the primary winding $T_1$ decreases, and finally reaches the Zener voltage of the Zener diode $ZD_1$ at time $t_3$.

When the Zener diode $ZD_1$ breaks down, the trigger voltage of the thyristor $SCR_1$ is produced in the resistor $R_{13}$ to place the thyristor $SCR_1$ in conduction.

When the thyristor $SCR_1$ comes in conduction, the electric charge stored in the capacitor C passes through the thyristor $SCR_1$, the diode $D_9$ and the resistor $R_9$, and capacitor C is discharged in accordance with the time constant set by the capacitor C and the resistor $R_9$.

The discharge of the inverse voltage stored in the capacitor C, i.e., the conduction of the thyristor $SCR_1$, causes the positive electrode (left side, FIG. 5) of the capacitor C to be virtually short circuited to the gate of thyristor SCR via the diode $D_9$. As a consequence, the potential of the gate of the thyristor SCR drops to the negative side to render conduction of the thyristor SCR impossible.

This state is retained for a period of time $\Delta t_1$ set by the time constant to completely discharge the capacitor C, that is, for a period of time from $t_3$ to $t_2$.

The timing in overrotation for conduction of the thyristor $SCR_1$, i.e., breakdown time $t_3$ of the Zener diode $ZD_1$, is set at a time earlier than normal conduction of the thyristor SCR would begin without overrotation, i.e., normal ignition time $t_1$ is within the range of time $\Delta t_1$. Accordingly, the normal ignition time $t_1$ is within the period for discharging the capacitor C. However, the thyristor SCR gate is shunted by diode $D_9$ to its cathode during the discharge of the capacitor C as previously mentioned, hence, it is impossible to place the thyristor SCR in conduction.

However, near the time $t_2$ at which discharge of the capacitor C is completed, the forward voltage (FIG. 6 (*a*) ) induced in the primary winding $T_1$ also increases. As a consequence, the gate potential of the thyristor SCR also rises gradually as shown in FIG. 6 (*c*) and has reached the trigger potential at time $t_2$, when discharge of the capacitor C is completed, to trigger the thyristor SCR, thus producing a spark discharge in plug P.

That is, ignition timing of the ignition circuit, indicated in FIG. 5 as TCI will delay by the time $\Delta t_2$ from time $t_1$ set by the resistor $R_2$ to time $t_2$ when discharge of the capacitor C completes.

This delay of ignition timing causes output of the internal combustion engine to decrease abruptly, thereby decreasing the rotational speed thereof.

In the ESG circuit, therefore, the Zener breakdown voltage of the Zener diode $ZD_1$ may suitably be set (a Zener diode $ZD_1$ having a suitable value of Zener voltage may be selected), whereby the rotational speed of the internal combustion engine for operating the switching circuit (ESG) may suitably be set. The value of angle of lag of ignition timing may freely be set by adjusting the time constant of the RC time constant circuit.

When for some cause of other, the rotational speed of the internal combustion engine tends to remain excessive in spite of the fact that the switch circuit (ESG) is operating, the amount of electric charge stored in the capacitor C on the inverse voltage cycle increases and the time $\Delta t_1$ increases. The amount of rotation of the flywheel per unit time increases for a given time delay. Thereby angle of lag which acts directly to reduce rotational speed of the internal combustion engine is greater as rotational speed is greater.

It will be appreciated that the switching circuit (ESG) affords the added advantage of prespark prevention since an inverse current flows in the primary winding $T_1$ when an inverse voltage is induced in the primary winding $T_1$. The same is true for the embodiment shown in FIG. 2.

What is claimed is:

1. An overrotation prevention circuit in a non-contact ignition circuit for an internal combustion engine, comprising:

an ignition coil, the secondary winding of said ignition coil being connected to a spark gap, the primary winding of said ignition coil when having a forward voltage induced therein, carrying a current which flows when a first gated thyristor is non-conducting, said current flowing through a transistor connected by its emitter and collector across said primary winding, and said current and said transistor are cut off to cause a spark at said gap when said first gated thyristor is caused to conduct;

a capacitor being connected in a undirectional charging circuit across said primary winding, said capacitor being charged when said primary winding has an inverse voltage induced therein;

a discharge circuit for discharging said capacitor after said charging, said discharging current causing said first thyristor to continue in a non-conducting state, whereby sparking at said gap is delayed;

a switching circuit, said switching circuit causing said capacitor to discharge when the rotation rate of said engine exceeds a selected limit.

2. The overrotation prevention circuit of claim 1 wherein said discharging current directly causes the gate-to-cathode voltage of said first thyristor to decrease thereby preventing conduction of said first thyristor during discharge.

3. The overrotation circuit of claim 1, and further comprising:

a first resistor connected between said collector and the transistor base, and said first thyristor is inserted between said transistor base and said emitter with the first thyristor anode connected to said transistor base;

a first thyristor gate circuit comprised of resistive elements and a diode, said gate circuit connected in parallel across said primary winding and one of said resistive elements being connected between said gate and said cathode of said first thyristor, said diode poled to flow current toward said cathode of said first thyristor; and a second resistor is inserted between said capacitor and the gate of said first thyristor, whereby an RC discharge circuit is provided to determine the duration of said delay in sparking; and a second gated thyristor in said switching circuit, and said capacitor discharges through the load terminals of said second thyristor and said discharge circuit when said second thyristor conducts; and a zener diode between the anode and gate of said second gated thyristor, the cathode of said zener diode and one terminal of said capacitor connected to the anode of said second thyristor; and a second resistor connected between the gate and cathode of said second gated thyristor; the cathodes of said first and second thyristors being connected together; and a second diode connected across said second thyristor, the cathode of said second diode being connected to the anode of said second thyristor and to said one terminal of said capacitor, and a third diode connected by its anode to the other terminal of said capacitor, said second and third diodes in series with said capacitor being connected across said primary winding to form said unidirectional charging circuit; and a third diode connected between the gate and cathode of said first thyristor, said gate connecting to the cathode of said third diode.

4. The overrotation circuit of claim 1, and further comprising:

a first resistor connected between said collector and the transistor base, and said first thyristor is inserted between said transistor base and said emitter with the first thyristor anode connected to said transistor base;

a first thyristor gate circuit comprised of resistive elements and a diode, said gate circuit connected in parallel across said primary winding and one of said resistive elements being connected between said gate and said cathode of said first thyristor, and one of said resistive elements being variable, said diode poled to flow current toward said cathode of said first thyristor;

whereby the trigger time of said first thyristor is selected by the setting of said variable resistive element.

5. The overrotation prevention circuit of claim 4 wherein a second resistor is inserted between said capacitor and the gate of said first thyristor, whereby said discharge circuit is an RC circuit to determine the duration of said delay in sparking.

6. The overrotation prevention circuit of claim 5 wherein:

said switching circuit includes a second gated thyristor having a gate circuit comprising a coil with a variable resistor across its terminals, the anode of said second thyristor being connected to one terminal of said capacitor, the cathodes of said first and second thyristors being connected together to one end of said coil, and the gate of said second thyristor being connected to the sliding terminal of said variable resistor; and wherein a second diode is connected across said second thyristor, the cathode of said second diode being connected to the anode of said second thyristor and to said one terminal of said capacitor, and a third diode connected by its anode to the other terminal of said capacitor, said second and third diodes in series with said capacitor being connected across said primary winding to form said unidirectional charging circuit; and wherein a third diode is connected between the gate and cathode of said first thyristor, said gate connecting to the cathode of said third diode.

7. The overrotation prevention circuit of claim 1 wherein said switching circuit includes a second gated thyristor and said capacitor discharges through the load terminals of said second thyristor and said discharge circuit when said second thyristor conducts.

8. The overrotation prevention circuit of claim 7 and further comprising: a zener diode between the anode and gate of said second gated thyristor, the cathode of said zener diode and said capacitor connected to the anode of said second thyristor; and a first resistor connected between the gate and cathode of said second gated thyristor, whereby at a condition of overrotation of said engine, the charge stored in said capacitor causes said zener diode to breakdown and conduct current through said resistor, triggering said second thyrister to discharge said capacitor and delay the spark at said gap.

9. The overrotation prevention circuit of claim 1 wherein the charge stored in said capacitor during said inverse voltage increases as said rotation rate of said engine increases, and the time for discharging said capacitor remains constant, whereby said spark is delayed over a greater angle of engine rotation as said engine overrotation rate increases.

* * * * *